US008495783B2

(12) United States Patent
Bos et al.

(10) Patent No.: US 8,495,783 B2
(45) Date of Patent: Jul. 30, 2013

(54) METHOD AND APPARATUS FOR CLEANING OF A BURNER

(75) Inventors: Erwin Bos, Frederikssund (DK); Niels Kristian Nielsen, Hørsholm (DK); Sven Erik Lyse-Petersen, Lynge (DK)

(73) Assignee: Haldor Topsoe A/S, Lyngby (DK)

( * ) Notice: Subject to any disclaimer, the term of this patent is extended or adjusted under 35 U.S.C. 154(b) by 1723 days.

(21) Appl. No.: 11/898,176

(22) Filed: Sep. 10, 2007

(65) Prior Publication Data

US 2008/0083076 A1 Apr. 10, 2008

(30) Foreign Application Priority Data

Oct. 6, 2006 (DK) ..... 2006 01296

(51) Int. Cl.
*A46B 13/02* (2006.01)
*F23J 1/00* (2006.01)

(52) U.S. Cl.
USPC ..... 15/104.095; 15/23

(58) Field of Classification Search
USPC ..... 15/104.14, 23, 104.05, 213, 65, 66, 15/104.09
IPC ..... A46B 13/02; F23J 1/00
See application file for complete search history.

(56) References Cited

U.S. PATENT DOCUMENTS

| | | | | |
|---|---|---|---|---|
| 3,696,563 | A * | 10/1972 | Rands | 451/466 |
| 3,750,214 | A * | 8/1973 | Caliendo et al. | 15/26 |
| 4,534,080 | A | 8/1985 | Young et al. | |
| 5,180,302 | A * | 1/1993 | Schwartz et al. | 431/348 |
| 2003/0177768 | A1 * | 9/2003 | Pellizzari | 60/737 |
| 2006/0154123 | A1 * | 7/2006 | Kim et al. | 429/20 |

FOREIGN PATENT DOCUMENTS

| | | |
|---|---|---|
| DE | 31 49 550 | 6/1983 |

* cited by examiner

*Primary Examiner* — Monica Carter
*Assistant Examiner* — Stephanie Berry
(74) *Attorney, Agent, or Firm* — Dickstein Shapiro LLP

(57) ABSTRACT

The present invention relates to a method for cleaning a burner by a burner cleaner. The method comprises removing a burner nozzle, partly inserting the burner cleaner into the burner, connecting a threaded guide of the cleaner to the burner at a thread of an inlet pipe, bringing a shaft being a part of the burner cleaner and partly surrounded by the guide to rotate by a motor, thereby bringing a flare brush connected to the other end of the shaft to hit inner surface of the burner and remove deposit from it, and moving the shaft with the flare brush in the guide enabling the flare brush to clean the inner surface of the burner. The invention further provides a burner cleaner, comprising a shaft, an annular, threaded guide mounted around and co-axially with the shaft, and being shorter than the shaft, a flare brush connected at one end of the shaft, and a motor connected to other end of the shaft.

7 Claims, 2 Drawing Sheets

METHOD AND APPARATUS FOR CLEANING OF A BURNER

BACKGROUND OF THE INVENTION

1. Field of the Invention

The invention relates to a method and apparatus for cleaning of burners.

The invention is especially directed to remove soot and other kinds of dirt, which deposit on inner surface of burners installed in fired, tubular reformers.

2. Description of Related Art

It is known that impurities are formed in burners, and that these impurities deposit on the inner surface of the burners, which affects performance of the burners.

In the publication issue of DE 3149550 a method for removing deposit during combustion is described. Small particles of sand are blown into the burner in such a way that they remove the deposit. They are collected at the end of the burner and removed from there. However, this method is unsuitable for a fired, tubular reformer with hundreds of burners.

In a report from Ammonia Plants & Related Facilities Symposia, 2001, B. R. Fisher describes cleaning of burners in a fired, tubular reformer with bronze wire brushes and cupper wires. He recommends avoiding steel wire brushes, as they can damage the ports of the burners.

However, brushes are not efficient for cleaning burners installed in tubular, fired reformers, as the burners comprise a venturi for air suction. A brush cannot clean an inner surface of a narrow pipe, which is enlarged in the other end than the end where a brush can be inserted.

Accordingly, it is an object of the invention to provide a method and an apparatus for effective and easy cleaning of burners, especially burners installed in fired, tubular reformers.

SUMMARY OF THE INVENTION

Pursuant to the above object, the present invention relates to a method for cleaning a burner by a burner cleaner. The burner comprises an inlet pipe, a venturi and a burner nozzle with a threaded connection to the inlet pipe. The method comprises that the burner nozzle is removed; that the burner cleaner is partly inserted into the burner; that the burner cleaner having a threaded guide is connected to the burner at the thread of the inlet pipe; that a shaft being a part of the burner cleaner and partly surrounded by the guide is brought to rotate by a motor being connected to one end of the shaft; that a flare brush connected to the other end of the shaft thereby is brought to hit inner surface of the burner and remove deposit from the inner surface; and that the shaft with the flare brush is moved in the guide enabling the flare brush to clean at least a part of the inner surface of the burner.

The invention further provides a burner cleaner, which comprises a shaft; an annular guide mounted around and co-axially with the shaft, the guide being threaded to connect it to a threaded end of the burner, and the guide being shorter than the shaft enabling the shaft to move in the guide; a flare brush connected at one end of the shaft, the brush being equipped with a plurality of wire ropes with spherical bodies and the brush being inside the burner when connected to the burner; and a motor connected to other end of the shaft.

Further embodiments are described in the sub-claims.

The present invention is suitable for efficient cleaning of a high number of burners with difficultly accessible inner surface.

DETAILED DESCRIPTION OF THE INVENTION

Figure 1:
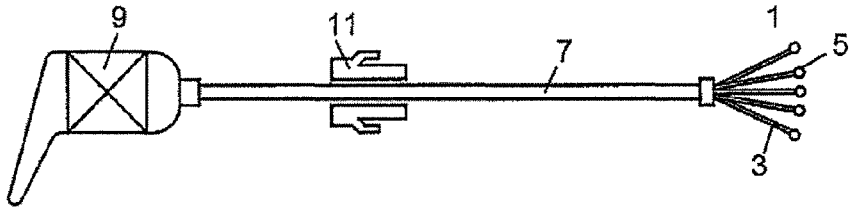
FIG. 1 is a cross-section of the burner cleaner of the invention.

A fired, tubular reformer is a big and important piece of equipment in plants producing ammonia, hydrogen, town gas synthesis gas and similar and comprises a high number of burners. A fired, tubular reformer often comprises hundreds of burners.

Dirt and impurities in combustion air deposit on the inner surface. Deposit changes the nature of the surface, which affects the flow pattern of fuel gas and combustion air and thereby the shape of flame.

Each burner must operate correctly, as it has to create a flame with the correct shape. If the combustion in one or more burners is not complete for instance due to wrong fuel/air ratio, the flame hits one or more tubes and damages them. Furthermore, a reformer burner must create the correct amount of heat. The heat flux is important in a reformer, as both the amount of heat and the heat distribution on the surface of reformer tubes are important in order to obtain the required endothermic reaction in the reformer.

Thereby, clean burners are needed and an easy and efficient cleaning method is important.

In a typical burner in a fired, tubular reformer fuel gas enters through an inlet nozzle surrounded by a tube, which then is enlarged to form a venturi. The venturi ensures proper aspiration of combustion air.

However, a burner with an inner surface in shape of a venturi cannot be cleaned by a simple brush or pressurised air. The cleaning is performed from the inlet end of the burner and a brush cannot reach the entire surface. Neither can pressurised air.

The invention provides a method and apparatus for cleaning such burners. The apparatus, burner cleaner, comprises a brush mounted on a shaft with a motor connected to the other end. The brush, a flare brush, comprises 3-5 wire ropes, each of which has a small spherical body at the end. The spherical bodies can be kept close to each other, when the burner cleaner is pushed into a burner. Flare brushes are commercially available.

A threaded guide is arranged around the shaft, this keeps the cleaner in position during the cleaning procedure.

The burner cleaner is of such a size that it can be held by hand when operated.

When a burner is going to be cleaned, it is removed from the equipment, typical a reformer, and taken to workshop. The burner nozzle is screwed off and the burner cleaner is screwed on by using the nozzle thread on the inlet pipes and the thread of the guide.

When the motor of the cleaner is switched on, the spherical bodies of the rotating brush hit the inner surface of the burner and knock off the deposit. The shaft is moved in the guide, so the entire surface of the burner is cleaned.

The loosened dirt is thereafter simply poured out of the burner.

In this way the entire surface of a burner is cleaned, even the venturi of the burner. This cleaning method is thorough, quick, easy and efficient, which is especially important when cleaning a high number of reformer burners.

Optionally, a burner can be cleaned in-situ.

DETAILED DESCRIPTION OF DRAWINGS

The burner cleaner is in more detail described by the drawings. FIG. 1 shows the cleaner itself. Brush 1 comprises a plurality of wire ropes 3 each having a spherical body 5 at the end. The brush 1 is connected to a shaft 7, which has a motor 9 connected to the other end. A guide 11 is mounted around the shaft 7.

Figure 2:
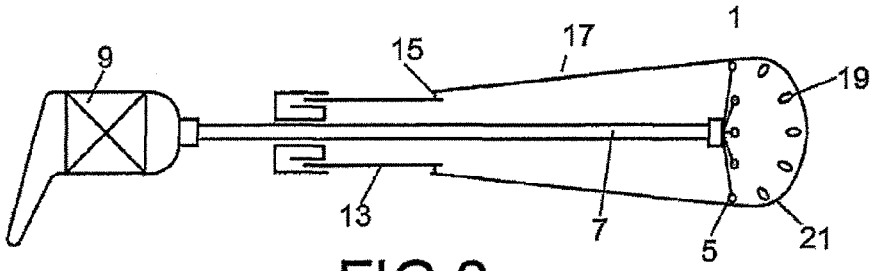
FIG. 2 is a cross-section of the burner cleaner of the invention inserted into a burner.

The cleaner inserted into a burner is shown in FIG. 2. Fuel gas enters the burner through inlet pipe 13, where fuel gas is accelerated, creating a vacuum, which sucks in combustion air through duct 15. Fuel gas and combustion air pass through venturi 17, where it is further accelerated, which ensures proper aspiration of air before leaving the burner through slots 19 on burner tip 21. The gas mixture ignites outside the burner.

Before cleaning, the brush 1 and the shaft 7 are inserted through the pipe 13 into the burner. When motor 9 is switched on, shaft 7 and brush 1 rotate so quickly that the spherical bodies 5 are flung out to the burner surface, where the deposit is knocked off. This will happen regardless how deeply the cleaner is inserted into the burner.

Figure 3:
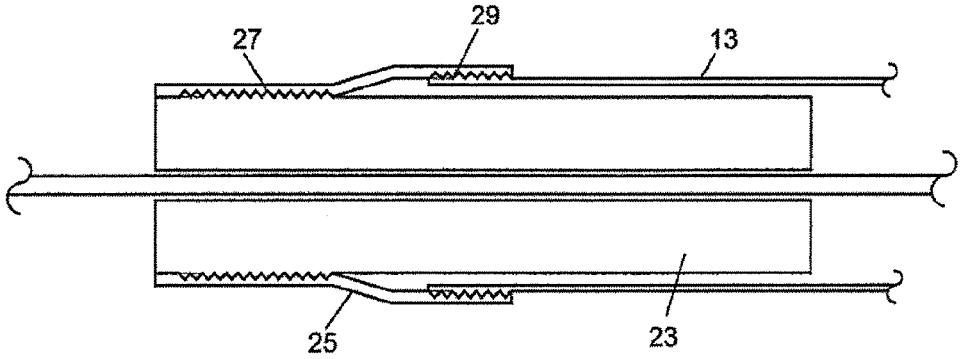
FIG. 3 is a cross-section of the connection of the invention between the burner cleaner and a burner.

The guide of the cleaner is shown in FIG. 3 in more detail. The guide comprises a teflon annular tube 23 partly surrounded by a metal union 25. They can be held together by a threaded connection 27 at one end of the annular tube and a narrow part of the union as shown in the figure.

FIG. 3 shows how the guide is fixed to the burner. Before this is possible, a burner fuel nozzle, which is not showing on the figure, is detached at its threaded connection to the burner inlet pipe.

The teflon annular tube 23 and a wider part of the metal union 25 are inserted around burner inlet pipe 13 and fixed by a threaded connection 29. The thread of the burner inlet pipe 13 is the thread, which is used for connecting the above mentioned fuel nozzle.

The invention is useful for cleaning all kind of burners, and especially advantageous for burners, which do not have an inner surface in a form of a straight tube.

EXAMPLES

One embodiment of the invention is a cleaner, where the shaft is 800-1200 mm, OD is 10-12 mm and made from SS 316, stainless steel.

The guide is 120-150 mm long with OD and ID according to inner diameter of inlet fuel pipe and diameter of shaft, respectively.

The annular part of the guide is made from Teflon and the threaded union is galvanic or from SS 316.

The brush fixed on the shaft has 3-5 wire ropes covering 38-102 mm inner diameter.

The flare brush has a cobalt base hard facing, which is flame-coated to the end of the stainless steel wire rope. The spherical bodies may further contain tungsten carbide or silicon carbide.

The motor rotates 1000-2000 rpm.

A preferred embodiment of the invention is a burner cleaner, where the shaft is 900-1100 mm long.

The guide is 130-140 mm long. The annular tube has an OD of 36-40 mm and an ID of 10.2-12.2 mm.

The union is 50-60 mm long and can be a 1¼/1½ inch standard union with inner thread.

The brush fixed on the shaft has 5 wire ropes covering an inner diameter of 100 mm when rotating.

Test Results

Measurements of flue gas composition were taken in a fired, tubular reformer in an 1100 MTPD ammonia plant. The burners had been in operation for 10 years and had been cleaned by a traditional method only half a year earlier without any significant effect. The fuel was natural gas, normally mixed with synthesis off-gas.

A probe was inserted through the furnace wall, i.e. through the hole for burner ignition, and samples of the flue gas were taken near three different burners.

The flue gas was analysed for the volumetric concentrations of $O_2$, CO and $CO_2$.

Then the burners were removed, taken to the workshop and cleaned in accordance with the invention.

The burners were 710 mm long and having inner diameter between 50 mm and 100 mm.

A burner cleaner according to the invention was used. The shaft was 1000 mm long with OD 10 mm and connected to a flare brush with five spherical bodies and a drilling machine, rotating 1300 rpm. The guide around the shaft being 140 mm long with 37/10.5 mm OD/ID was connected to the burner.

When the motor was switched on and the brush was rotating, the shaft was moved in the guide and the inner surface of a substantial part of the straight inlet fuel pipe and all the venturi part of the burner was cleaned.

After cleaning and re-installation of the burners, the flue gas was analysed in the same way as before the cleaning. The results are given in Table 1.

TABLE 1

Flue gas compositions before and after cleaning according to the invention.

| | Burner No. | | | | | |
|---|---|---|---|---|---|---|
| | 4-1-2 before | 4-1-2 after | 4-1-3 before | 4-1-3 after | 1-2-4 before | 1-2-4 after |
| $O_2$, vol. % | 0 | 1.91 | 0 | 2.38 | 1.47 | 3.38 |
| $CO_2$, vol. % | 12 | 10.91 | 12 | 10.64 | 11.16 | 10.07 |
| CO, ppm | 5000 | 0 | 5000 | 0 | 181 | 0 |

Measurements before cleaning show low oxygen contents or even zero and high content of CO. This clearly indicates that the dirty venturi in the burner was unable to suck-in sufficient combustion air to ensure complete combustion.

After cleaning, an oxygen surplus was measured and CO was not present, indicating that the burner was efficiently cleaned and able to provide the required amount of combustion air.

The invention claimed is:

1. A burner cleaner for cleaning a burner, the burner comprising an inlet pipe, a venturi and a burner nozzle with a threaded connection to the inlet pipe, the burner cleaner comprising:

(a) a shaft;

(b) an annular guide mounted around and co-axially with the shaft, the guide being threaded to allow the guide to connect to and disconnect from a threaded end of the burner, and the guide being shorter than the shaft enabling the shaft to move in the guide, the guide having an annular tube that is inserted within the inlet pipe of the burner;

(c) a rotating flare brush connected at one end of the shaft, the rotating brush being equipped with a plurality of wire ropes, each of the wire ropes terminating in a spherical body at an end, each of the spherical bodies being flame-coated, and the brush being inside the burner when connected to the burner; and (d) a motor connected to other end of the shaft, wherein actuation of the motor allows the spherical bodies of the rotating brush to be flung out to an inner surface of the venturi of the burner and to hit the inner surface of the venturi, to remove deposit from the burner.

2. A burner cleaner according to claim 1, wherein the guide comprises the annular tube and a union; the annular tube tightly surrounds the shaft; part of the union is surrounding and fixed to one end of the annular tube; and remaining part of the union is surrounding and spaced apart from the annular tube and equipped with an inside thread.

3. A burner cleaner according to claim 2, wherein the annular tube is made from Teflon™.

4. A burner cleaner according to claim 2, wherein the union is made from stainless steel or galvanic steel.

5. A burner cleaner according to claim 1, wherein the spherical bodies are made from a cobalt-containing metal alloy.

6. A burner cleaner according to claim 2, wherein the shaft has a length of 800-1200 mm and an outer diameter of 10-12 mm;

the annular tube of the guide has a length of 120-150 mm, an outer diameter of 36-40 mm and an inner diameter of 10.2-12.2 mm;

the union of the guide has a length of 50-60 mm; the brush has 3-5 wire ropes with spherical bodies; and the motor rotates 1000-2000 rpm.

7. A burner cleaner according to claim 1, wherein the burner is installed in a tubular, fired reformer.

* * * * *